US011543214B2

(12) United States Patent
Citterio et al.

(10) Patent No.: US 11,543,214 B2
(45) Date of Patent: Jan. 3, 2023

(54) BALLISTIC LAMINATE COMPRISING TEXTILE ELEMENTS IN WHICH BALLISTIC THREADS INTERSECT NON-BALLISTIC THREADS

(71) Applicant: Società per Azioni Fratelli Citterio, Monza (IT)

(72) Inventors: Giorgio Citterio, Monza (IT); Filippo Citterio, Monza (IT)

(73) Assignee: Società per Azioni Fratelli Citterio, Monza (IT)

( * ) Notice: Subject to any disclaimer, the term of this patent is extended or adjusted under 35 U.S.C. 154(b) by 177 days.

(21) Appl. No.: 16/497,878

(22) PCT Filed: Mar. 27, 2018

(86) PCT No.: PCT/EP2018/057821
§ 371 (c)(1),
(2) Date: Sep. 26, 2019

(87) PCT Pub. No.: WO2018/178103
PCT Pub. Date: Oct. 4, 2018

(65) Prior Publication Data

US 2020/0103205 A1 Apr. 2, 2020

(30) Foreign Application Priority Data

Mar. 31, 2017 (IT) ..... 102017000035645
Mar. 31, 2017 (IT) ..... 102017000035710

(51) Int. Cl.
*D03D 15/00* (2021.01)
*F41H 5/04* (2006.01)

(52) U.S. Cl.
CPC ..... *F41H 5/0478* (2013.01)

(58) Field of Classification Search
CPC .. B32B 5/024; B32B 5/08; B32B 5/12; B32B 2250/02; B32B 2262/14; B32B 2262/148;
(Continued)

(56) References Cited

U.S. PATENT DOCUMENTS 4,181,768 A * 1/1980 Severin ..... B32B 27/12 442/246
5,180,880 A 1/1993 Zufle
6,610,618 B1 * 8/2003 Bottger ..... D03D 11/00 442/239
7,132,382 B2 11/2006 McCullough et al.
(Continued)

FOREIGN PATENT DOCUMENTS

RU 2217531 C2 11/2003
RU 2217532 C2 11/2003
(Continued)

OTHER PUBLICATIONS

"From Russia with Science—the Future Fibre has Arrived!" Winter/Spring 2014, Soldiermod, vol. 12, 18-20. https://www.soldiermod.com/volume-12/pdfs/articles/autx-aat.pdf (Year: 2014).*
(Continued)

*Primary Examiner* — Matthew D Matzek
(74) *Attorney, Agent, or Firm* — Lando & Anastasi, LLP

(57) ABSTRACT

Ballistic laminate for implementing a ballistic structure comprising at least two textile layers placed one on top of the other and joined together. The layers (elements) comprise at least a first textile element, of which the ballistic warp threads, having a count higher than 40 dtex, intersect non-ballistic weft threads, having a count less than 40 dtex, and at least a second textile element, in which non-ballistic warp threads, having a count less than 40 dtex, intersect ballistic weft threads having a count higher than 40 dtex. These at least two elements are joined together using various technologies to obtain a stable structure in which the energy
(Continued)

absorption in the face of projectiles is greater than the energy absorption for conventional warp-weft fabrics for the same weight per square meter.

17 Claims, 1 Drawing Sheet

(58) Field of Classification Search
CPC ..... B32B 2307/50; F41H 5/00; F41H 5/04; F41H 5/0471–0485; D03D 15/00; D03D 15/20; D03D 15/283; D03D 15/30; D03D 15/40; D03D 15/43

USPC ..... 442/208, 209, 213, 239, 135, 240, 402; 89/36.02
See application file for complete search history.

(56) References Cited

U.S. PATENT DOCUMENTS

| | | | | |
|---|---|---|---|---|
| 7,820,565 | B2 | 10/2010 | van Heerden et al. | |
| 2007/0099526 | A1 | 5/2007 | Heerden et al. | |
| 2010/0307629 | A1 | 12/2010 | Citterio | |
| 2013/0090029 | A1* | 4/2013 | Vito | B32B 5/024 442/2 |
| 2016/0289869 | A1 | 10/2016 | Shahkarami | |

FOREIGN PATENT DOCUMENTS

| | | | |
|---|---|---|---|
| RU | 2557635 | C2 | 7/2015 |
| WO | WO-2004074761 | A1 | 9/2004 |

OTHER PUBLICATIONS

Gex-Collet, A.; International Search Report for PCT/EP2018/057821; dated May 25, 2018; 4 pages.

* cited by examiner

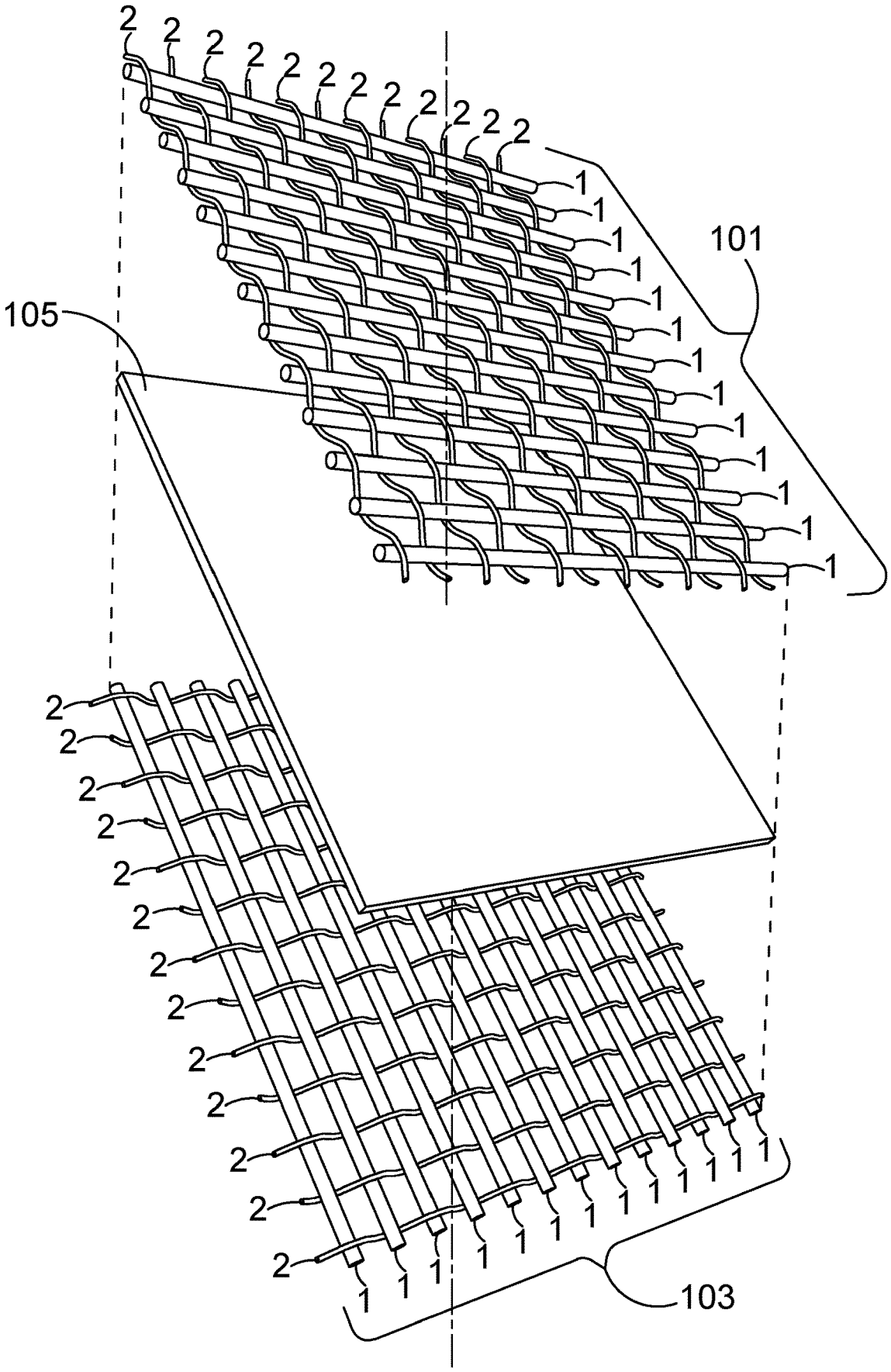
101
103
105
1
2

BALLISTIC LAMINATE COMPRISING TEXTILE ELEMENTS IN WHICH BALLISTIC THREADS INTERSECT NON-BALLISTIC THREADS

TECHNICAL FIELD

The present invention relates to a textile structure for implementing ballistic protection which makes it possible to reduce the weight whilst maintaining the same ballistic performance.

TECHNICAL BACKGROUND

A primary requirement in the production of personal ballistic protections is that of combining high performance (in terms both of energy absorbed and of reduction in the trauma brought about by the energy of the incident projectile) with a reduction in weight and with sufficient flexibility and thus comfort for the wearer.

It has been found that the straighter the threads are arranged the greater the resulting ballistic performance.

Unidirectional threads need to be stabilised by further textile elements, as for example disclosed in U.S. Pat. No. 7,820,565 to Barrday.

Tejin U.S. Pat. No. 7,132,382 claims a so called semi-unidirectional structure, in which non-ballistic threads are intertwined with ballistic threads.

To provide stabilisation, the non-ballistic threads have to have a count significantly higher than 50 dtex.

The diameter of said thread when it is woven together with ballistic threads creates undulations which are disadvantageous both for ballistic purposes per se and for the purposes of abrasion resistance. According to this patent, the number of non-ballistic threads is lower than the number of ballistic threads. However, the low number of intersections between the ballistic threads and non-ballistic threads does not make possible sufficient stability of the fabric, which thus has to be covered on both sides with protective films, optionally of different types, with subsequent application of pressure and heat.

A further drawback is that the non-ballistic threads do not contribute to the ballistic characteristics of the resulting structure, therefore they constitute a sort of dead weight, particularly when the ballistic threads have a count less than 930 dtex.

In bidirectional or multidirectional laminates, a series of optionally pre-impregnated ballistic threads are placed on top of at least one second series of optionally pre-impregnated ballistic threads. Subsequently, they are calendered and covered on both faces with polymer films of different types.

Since there are no intersections between the actual threads, the structure obtained is unstable and unable to pass "tumbling" tests as provided by American specifications N.J 01 01 06.

In multiaxial fabrics, as described for example in Citterio patent WO 2004 074761 A1, the ballistic threads of at least two layers are kept interconnected by a secondary structure by way of various types of stitching, for example tricot stitching. To carry out connection of this type, the needles must of necessity pass through the ballistic threads, inevitably causing breakage of some fibres of the component ballistic threads.

OBJECT OF THE INVENTION

The primary object of the present invention is to propose a ballistic protection element which reduces the drawbacks of the prior art.

SUMMARY OF THE INVENTION

This result has been achieved in accordance with the present invention by implementing a ballistic laminate for the manufacture of a ballistic protection structure, the laminate comprising at least a first textile element and at least a second textile element, the at least first textile element comprising a weft made of a plurality of non-ballistic threads having a count less than 40 dtex and a warp made of a plurality of ballistic threads having a count higher than 40 dtex, the at least second textile element comprising a weft made of a plurality of ballistic threads having a count higher than 40 dtex and a warp made of a plurality of non-ballistic threads having a count less than 40 dtex, wherein the ratio R between the count of the ballistic threads (tfB) and the count of the non-ballistic threads (tfnB) is between 5 and 120, in accordance with the formula $5<R<120$, where $R=tfB/tfnB$.

In a preferred embodiment the dynamically measured mechanical strength of the ballistic threads is at least 20% higher than the static strength of the same threads. The static strength is measured with a quasi-static longitudinal test according to ASME standard test method with an applied strain rate of 0.001/s and wherein the dynamically measured mechanical strength is measured applying a high strain rate in the range 1,000/s to 2,000/s.

Preferably the ballistic threads are made of one or more of the following material: aramidic, poly-aramidic, ultra-high-molecular-weight polyethylene (UHMWPE), copolyaramidic, polybenzoxazole, polybenzothiazole, liquid crystals, carbon glass, optionally mixed together. In a preferred embodiment the ballistic threads are made of a material including the fibre AuTx® produced by Kamenskvolokno® JSC.

The at least first textile element and the at least second textile element can be optionally bound together by means of adhesive with one or more of the following materials: thermoplastic polymers, thermosetting polymers, elastomeric polymers, viscous or viscoelastic polymers, optionally mixed together. The adhesive polymers for the bonding can be in one or more of the following forms: films, powders, pastes, threads, strips, optionally applied in discontinuous form. Preferably the amount of adhesive polymer is between 2 and 100 $g/m^2$ and wherein the amount of impregnating polymer is between 8 $g/m^2$ e 180 $g/m^2$. Alternatively the at least first textile element and the at least second textile element are bound together by stitching or could be bound together by means of needle punch process.

Advantageously, the laminate is successively at least partially impregnated with one or more of the following polymers: thermoplastic, thermosetting, elastomeric, viscous, viscoelastic, water and/or oil repellent.

The weight of each textile element is normally between 10 $g/m^2$ and 500 $g/m^2$. The ballistic threads have a static strength higher than 200 cN/Tex and a dynamically measured mechanical strength equal to or higher than 500 cN/Tex. Advantageously the ballistic threads have tensile strength greater than 20 cN/dtex, modulus greater than 40 GPa and elongation at break greater than 1%. The present invention further relates to a ballistic protection comprising at least one layer of ballistic laminate as described above.

BRIEF DESCRIPTION OF THE DRAWING

These and further advantages, objects and features of the present invention will be better understood by any specialist in the field from the following description and from the accompanying drawings, which relate to embodiments of an exemplary nature and are not to be understood as limiting, in which:

FIG. 1 is a perspective view of a structure for implementing ballistic protections in accordance with a possible embodiment of the present invention.

DETAILED DESCRIPTION

The ballistic laminate according to the present invention is implemented using conventional warp-weft looms. In a preferred form, the layers (elements) comprise at least a first textile element, of which the ballistic warp threads, having a count higher than 40 dtex, intersect non-ballistic weft threads having a count less than 40 dtex, and at least a second textile element, of which the non-ballistic warp threads, having a count less than 40 dtex, intersect ballistic weft threads having a count higher than 40 dtex.

These two elements are subsequently joined together, optionally using different technologies to obtain a stable structure.

The non-ballistic threads used for the present invention preferably have a count of between 6 dtex and 39 dtex and more preferably between 10 and 30 dtex, said non-ballistic wires comprising threads of polyethylene, polyamide, acrylic, viscose, meta-aramid, polyvinylalcohol acetate, optionally in the soluble cotton form thereof, bamboo derivatives, implemented in both continuous and discontinuous form. Advantageously, said threads can be twisted around with variable twists of between 10 and 1000 turns per metre.

Alternatively, the threads which are optionally not twisted around can be subjected to an interlacing process. Said threads may also be in the form of monofilaments, especially when the count is less than 10 dtex. More types of thread can be used, optionally mixed together. For better temporary stabilisation of the elements, water-soluble and solvent-soluble threads may additionally be used, and can be disposed of after the at least two elements have been bonded.

For example, continuous water-soluble threads may be used, for example those having the trade name Solvron or Mintval, of which the temperatures of dissolution in water are less than 90° C.

Hot melt threads may also be used, the temperature of which has to be less than the melting point of the ballistic threads.

The features of the ballistic threads are essential for the purposes of the performance of the laminate. The ballistic threads for implementing the laminate according to the present invention preferably have a tensile strength of 20 cN/dtex, more preferably a tensile strength of 30 cN/dtex and more preferably a tensile strength greater than 40 cN/dtex.

Copolyaramid threads in which the dynamically measured mechanical strength is at least 20% greater than the static strength (or resistance), according to a test method carried out by the American Purdue University and published in copolyaramid data sheets such as those bearing the name AuTx® or Rusar® or Ruslan® produced by Kamenskvolokno® JSC, are particularly useful. To carry out the test, the Laboratories of the Purdue University applied the following parameters:

- for the so called "static strength" (or more precisely "quasi-static"), a quasi-static longitudinal test were performed according to the ASME standard test method for tensile properties of single textile fibers (D3822-07). It was applied a quasi-static strain rate of 0.001/s;
- for the "dynamically measured mechanical strength" a high strain rate from 1,000/s to 2,000/s has been applied.

In these products (AuTx® produced by Kamenskvolokno® JSC), the tensile strength as measured by conventional methods is 230 cN/tex, whilst the dynamic tensile strength as measured by the procedure developed by said University is 522 cN/tex. Other thread technologies are found to be advantageous for the object of the present invention, including aramid threads, polybenzoxazole (PBO) threads, polybenzothiazole (PBT) threads, polyethylene threads, those having molecular weights greater than 1,000,000 indicated as UHMWPE.

A second parameter characterising the ballistic fibres is found to be the tensile modulus. Ballistic threads having tensile moduli of between 40 and 200 GPa are found to be particularly useful.

To implement the ballistic laminate according to the present invention, ballistic threads may be used characterised by a count of between 60 and 4000 dtex, more preferably between 120 and 900 dtex and more preferably between 280 and 600 dtex.

Particularly for the finer counts, it is useful to provide 10 to 200 turns of twisting. Alternatively, the thread may be subjected to a phase of interlacing the individual component fibres of the thread.

Advantageously, the ratio R between the count of the ballistic threads (tfB) and the count of the non-ballistic threads (tfnB) is between 5 and 120, in accordance with the formula $5<R<120$, where $R=tfB/tfnB$.

The at least two layers (textile elements) are similar to a warp/weft structure where the weft threads intertwine with the warp threads, in accordance with some schemes (reinforcements) based for example on single or double canvas, twill or satin textiles, which are well known to specialists in the field.

FIG. 1 shows a preferred embodiment of the present invention, in which the at least first textile element 101 is implemented by placing the non-ballistic threads 2 in the weft and the ballistic threads 1 in the warp. The second textile element 103 comprises the ballistic threads 1 in the weft and the non-ballistic threads 2 in the warp. The order in which the at least first textile element 101 and the at least second textile element 103 are arranged may also be reversed, and the number of textile elements may vary, but preferably in an even number with alternation between elements of the first type, having a weft having non-ballistic threads and a warp having ballistic threads, and elements of the second type, having a warp having ballistic threads and a warp having non-ballistic threads.

The weight per $m^2$ of the construction of the at least first textile element is advantageously substantially equal or similar to the weight and to the construction of the at least one second textile element.

The two textile elements thus obtained are placed one on top of the other and joined.

In a preferred embodiment of the present invention, a joining system is represented by the interposition of a bonding layer, optionally discontinuous, implemented using thermoplastic, thermosetting, elastomer, viscous or viscoelastic polymers in the form for example of films, strips, powders or pastes. In a preferred embodiment, a thermoplastic film is used. FIG. 1 shows an interposition layer 105 in the form of a film.

The amount of bonding material applied is based on the weight formed by the sum of the weights of the textile elements. Generally, in terms of percentage this amount is between 2% and 50%. The bonding material may consist of substances of various chemical families, including polyethylenes, polyurethanes, acrylics, polyesters, epoxides, phenolic compounds, polyamides, vinyl compounds, polybutene compounds, ionomers. The interposition of the bonding layer is followed by pressing with application of heat. Typical pressure values are between 1 and 250 kg/cm$^2$. Typical temperature values are between 50° C. and 250° C. These values are selected on the basis of the features of the bonding layer; after said operation, the section of the ballistic threads, which is normally round, takes on a strip configuration having better "coverage", which is very useful in the field of ballistics. The increased contact area of the bonding layer increases the strength of adhesion between the elements, thus creating a highly stable join.

In one possible alternative embodiment, this joining takes place by way of stitching between the textile elements which are placed one on top of the other. The various types of stitching are sufficiently known, and are not described herein; of the various types of stitching, the "tricot" system is advantageously used. In this case, aside from the combined element, it is possible to insert, between the elements, a further textile element formed by felts which are also formed by ballistic fibres.

In a further possible embodiment, this joining is carried out by needle punching. The fibres used for this operation may have ballistic or non-ballistic features. The amount of fibres used is advantageously between 2 g/m$^2$ and 100 g/m$^2$.

In this case, if the fibres used for the needle punching are ballistic, the tensile strength is advantageously higher than 15 cN/tex.

Thus, for example, aramid fibres, PVA fibres, high-molecular-weight polyethylene fibres, liquid crystal fibres, copolyaramid fibres are used. The needle punching fibres, when non-ballistic, generally have a tensile strength less than 10 cN/text; these include low-molecular-weight polyethylene fibres, polyester fibres, polyamide fibres, polyvinylalcohol fibres, viscose fibres, acetate fibres or natural fibres such as hemp, cotton, silk ramie or bamboo fibres.

Lamination obtained by applying a simple pressure, which is advantageous for ballistic purposes, is also useful in these last two forms of join.

The laminates thus obtained can advantageously subsequently be impregnated. The impregnation systems are well known to experts in the field and therefore will not be described.

Thermoplastic, thermosetting, elastomeric, viscous or viscoelastic polymers, normally dissolved in solvent, such as polyurethanes, acrylics, polybutylene compounds, phenolic compounds, optionally mixed together, are found to be particularly useful for impregnation.

If oil/water repellence features are desired for the laminate, the impregnated polymers have polymers added having at least 6 carbon atoms in the fluorinated chain.

The total amount of resin applied is between 2% and 50% based on the weight of the laminate.

The at least two textile elements may also be individually impregnated and subsequently coupled together, optionally without the interposition of bonding substances, with the application of pressure and heat; in this case the bonding substance comes from the polymers which impregnate the individual elements and which, after the application of the pressure and heat, become concentrated on the outer surfaces of said elements, making close contact possible between the at least two individual elements.

EXAMPLES

To evaluate the ballistic performances of the laminate according to the present invention in terms of absorbed energy measured in J/km/m$^2$, stratifications of conventional fabrics and other ballistic laminates were prepared, having a weight of 3.5 kg/m$^2$±3%.

These stratifications were subjected to ballistic testing, using Remington® brand projectiles of calibre 9 mm and weight 8 grams, measuring the V50 in accordance with standard US NJ 01 01 004.

Comparative Example 1 (Prior Art)

This example used 18 layers of a conventional warp-weft fabric implemented using aramid fibres of count 930 dtex.

The weight of the individual layer was approximately 194 g/m$^2$; the V50 obtained is 400 m/s.

The specific energy absorbed was calculated using the formula $E=1\ mv^2/P$, in which P is the weight per m$^2$ of the protection, m represents the mass of the projectile, and $V^2$ represents the measured speed (V50) squared.

The energy absorbed was thus equal to 182 J/kg/m$^2$.

Comparative Example 2 (Prior Art)

This example used 18 layers of conventional fabric implemented using new-generation microfilament-based aramid fibres.

The weight of the individual layer was approximately 194 g/m$^2$ and the V50 obtained was 410 m/s, which corresponds to an absorbed energy of 192 J/kg/m$^2$.

Comparative Example 3 (Prior Art)

This example used 7 layers of a unidirectional, multiaxial fabric of a weight of 500 g/m$^2$ using conventional aramid fibres.

The V50 obtained was 440 m/s, which corresponds to an absorbed energy of 221 J/kg/m$^2$.

Comparative Example 4 (Prior Art)

This example used 15 layers of purely unidirectional fabric of a weight of 235 g/m$^2$, which were impregnated and subsequently covered on both sides with 10 g/m$^2$ polythene film.

The V50 obtained was 226 J/kg/m$^2$.

Comparative Example 5 (Prior Art)

This example used 32 layers of fabric implemented using copolyaramid thread of a weight of 110 g/m$^2$ for each individual layer. The weaving of the twill 3 type was carried out on conventional looms. The features of the copolyaramid thread are as follows:

Dynamic tensile strength 522 cN/tex

Static tensile strength 230 cN/tex

The energy absorbed was 309 J/kg/m$^2$.

Example 1

To implement the ballistic protection for comparison, 16 laminates according to the present invention were used. The laminates were obtained using the same aramid ballistic threads mentioned in comparative example 1, having a count of 930 dtex.

The textured polyester non-ballistic threads had a count of 30 dtex.

The individual elements were woven on conventional looms using a single canvas construction.

Each individual element weighs±101 g/m$^2$, of which 3.2 g/m$^2$ is polyester non-ballistic thread and 97.8 g/m$^2$ is 930 dtex aramid ballistic thread.

The individual elements were placed one on top of the other as shown in FIG. 1 with interposition of a 15 g/m$^2$ polyurethane film.

They were subsequently calendered continuously at a pressure of 40 bar and a temperature of 120° C. The final weight was 218 g/m$^2$ and the weight of the whole stratification was 3.478 kg/m$^2$.

For comparison with comparative example 1, the laminate was subjected to the same ballistic tests but with an increasing speed. In terms of V50, the limit recorded was 520 m/s, which corresponds to an absorbed energy of 240 J/kg/m$^2$.

Example 2

The same test was repeated using 294 dtex AuTx® copolyaramid threads in which the static tensile strength was 230 cN/tex and in which the dynamic tensile strength was 522 cN/tex.

The weight of each individual element was 101 g/m$^2$, of which 6 g/cm$^2$ was 20 dtex polyester thread. When a 15 g/m$^2$ polyurethane film was interposed between two individual elements as shown in FIG. 1, the final total weight per layer was 218 g/m$^2$; they were laminated continuously at a pressure of 40 bar and a temperature of 120° C.

16 laminates were used for the stratification, corresponding to a total weight of 3.488 kg/m$^2$. The V50 obtained was 570 m/s, with corresponding absorbed energy of 370 J/kg/m$^2$.

It is thus clear that, both when using conventional ballistic threads and when using ballistic threads in which the static tensile strength is much lower than the dynamically measured tensile strength, the laminate according to the present invention, as shown in Examples 1 and 2, is superior to conventional warp/weft fabrics by more than 20% in terms of absorbed energy.

However, that is not all; the laminated fabric according to the present invention exhibits superior ballistic features even by comparison with unidirectional or multiaxial laminates such as are specified in comparative examples 3, 4 and 5.

It will be appreciated that in the context of the present invention the term "polymer" refers both to polymer material and to natural or synthetic resin and mixtures thereof. It will further be appreciated that the term "fibre" refers to elongate bodies having a longitudinal dimension much greater than the transverse dimension.

In practice, the implementation details may in any case vary in an equivalent manner with regard to the individual constructional elements described and illustrated and with regard to the nature of the specified materials, without thereby departing from the adopted solution concept, and thus whilst remaining within the limits of the protection conferred by the present patent.

The invention claimed is:

1. A ballistic laminate for the manufacture of a ballistic protection structure, the laminate comprising at least a first textile element and at least a second textile element, the at least first textile element comprising a weft made of a plurality of non-ballistic threads having a count less than 40 dtex and a warp made of a plurality of ballistic threads having a count between 280 and 600 dtex, the at least second textile element comprising a weft made of a plurality of ballistic threads having a count between 280 and 600 dtex and a warp made of a plurality of non-ballistic threads having a count less than 40 dtex, wherein the ratio R between the count of the ballistic threads (tfB) and the count of the non-ballistic threads (tfnB) is between 5 and 120, in accordance with the formula $5<R<120$, where R=tfB/tfnB, and wherein the weft of at least first textile element has a count between 10 and 30 dtex and the warp of the at least second textile element has a count between 10 and 30 dtex.

2. The ballistic laminate according to claim 1 wherein the dynamically measured mechanical strength of the ballistic threads is at least 20% higher than the static strength of the same threads.

3. The ballistic laminate according to claim 2 wherein the static strength is measured with a quasi-static longitudinal test according to ASME standard test method with an applied strain rate of 0.001/s and wherein the dynamically measured mechanical strength is measured applying a high strain rate in the range 1,000/s to 2,000/s.

4. The ballistic laminate according to claim 1 wherein the ballistic threads are made of one or more of the following material: aramidic, poly-aramidic, ultra-high-molecular-weight polyethylene (UHMWPE), copolyaramidic, polybenzoxazole, polybenzothiazole, liquid crystals, carbon glass, optionally mixed together.

5. The ballistic laminate according to claim 4 wherein the ballistic threads are made of a material including copolyaramidic fibers.

6. The ballistic laminate according to claim 1 wherein the at least first textile element and the at least second textile element are bound together by means of adhesive with one or more of the following materials: thermoplastic polymers, thermosetting polymers, elastomeric polymers, viscous or viscoelastic polymers, optionally mixed together.

7. The ballistic laminate according to claim 6 wherein the adhesive polymers for the bonding are in one or more of the following forms: films, powders, pastes, threads, strips, optionally applied in discontinuous form.

8. The ballistic laminate according to claim 1 wherein the at least first textile element and the at least second textile element are bound together by stitching.

9. The ballistic laminate according to claim 1 wherein the at least first textile element and the at least second textile element are bound together by means of needle punch process.

10. The ballistic laminate according to claim 1 wherein the laminate is successively at least partially impregnated with one or more of the following polymers: thermoplastic, thermosetting, elastomeric, and viscoelastic.

11. The ballistic laminate according to claim 10 wherein the amount of impregnating polymer is between 8 g/m$^2$ and 180 g/m$^2$.

12. The ballistic laminate according to claim 1 wherein the weight of each textile element is between 10 g/m$^2$ and 500 g/m$^2$.

13. The ballistic laminate according to claim 1 wherein the ballistic threads have a static strength higher than 200 cN/Tex and a dynamically measured mechanical strength equal to or higher than 500 cN/Tex.

14. The ballistic protection structure comprising at least one ballistic laminate according to claim 1.

15. The ballistic laminate according to claim 6 wherein the amount of adhesive polymer is between 2 and 100 $g/m^2$.

16. A ballistic laminate for the manufacture of a ballistic protection structure, the laminate comprising at least a first textile element and at least a second textile element, the at least first textile element comprising a weft made of a plurality of non-ballistic threads having a count less than 40 dtex and a warp made of a plurality of ballistic threads having a count between 280 and 600 dtex, the at least second textile element comprising a weft made of a plurality of ballistic threads having a count between 280 and 600 dtex and a warp made of a plurality of non-ballistic threads having a count less than 40 dtex, wherein the ratio R between the count of the ballistic threads (tfB) and the count of the non-ballistic threads (tfnB) is between 5 and 120, in accordance with the formula $5<R<120$, where $R=tfB/tfnB$, and wherein the weft of at least first textile element has a count between 10 and 30 dtex.

17. A ballistic laminate for the manufacture of a ballistic protection structure, the laminate comprising at least a first textile element and at least a second textile element, the at least first textile element comprising a weft made of a plurality of non-ballistic threads having a count less than 40 dtex and a warp made of a plurality of ballistic threads having a count between 280 and 600 dtex, the at least second textile element comprising a weft made of a plurality of ballistic threads having a count between 280 and 600 dtex and a warp made of a plurality of non-ballistic threads having a count less than 40 dtex, wherein the ratio R between the count of the ballistic threads (tfB) and the count of the non-ballistic threads (tfnB) is between 5 and 120, in accordance with the formula $5<R<120$, where $R=tfB/tfnB$, and wherein the warp of the at least second textile element has a count between 10 and 30 dtex.

* * * * *